US006990819B2

(12) United States Patent
Darling

(10) Patent No.: US 6,990,819 B2
(45) Date of Patent: Jan. 31, 2006

(54) DRYER SYSTEM FOR THE PREVENTION OF FROST IN AN ULTRA LOW TEMPERATURE FREEZER

(75) Inventor: William Brian Darling, Asheville, NC (US)

(73) Assignee: Kendro Laboratory Products, Newtown, CT (US)

( * ) Notice: Subject to any disclaimer, the term of this patent is extended or adjusted under 35 U.S.C. 154(b) by 190 days.

(21) Appl. No.: 10/724,624

(22) Filed: Dec. 2, 2003

(65) Prior Publication Data

US 2005/0028538 A1 Feb. 10, 2005

Related U.S. Application Data

(60) Provisional application No. 60/492,969, filed on Aug. 7, 2003.

(51) Int. Cl.
*F25D 17/06* (2006.01)

(52) U.S. Cl. ..... 62/94; 62/271

(58) Field of Classification Search ..... 62/92, 62/93, 271, 94; 96/7
See application file for complete search history.

(56) References Cited

U.S. PATENT DOCUMENTS

| | | | | | |
|---|---|---|---|---|---|
| 5,259,896 | A | * | 11/1993 | Park et al. | 156/78 |
| 5,768,897 | A | * | 6/1998 | Rainville et al. | 62/94 |
| 6,301,907 | B1 | * | 10/2001 | McCollin et al. | 62/93 |
| 6,397,620 | B1 | * | 6/2002 | Kelly et al. | 62/275 |
| 6,616,735 | B1 | * | 9/2003 | Burban et al. | 96/8 |
| 2003/0164091 | A1 | * | 9/2003 | Hill et al. | 95/90 |

* cited by examiner

*Primary Examiner*—Melvin Jones
(74) *Attorney, Agent, or Firm*—Baker & Hostetler LLP; Sean A. Pryor

(57) ABSTRACT

A dryer system for frost prevention in an ultra low temperature freezer includes a passive port coupled to an air dryer apparatus.

16 Claims, 3 Drawing Sheets

DRYER SYSTEM FOR THE PREVENTION OF FROST IN AN ULTRA LOW TEMPERATURE FREEZER

PRIORITY

This application claims priority to the Provisional Patent Application, 60/492,969 filed Aug. 7, 2003, the disclosure of which is incorporated herein by reference.

FIELD OF THE INVENTION

The present invention relates generally to a system for frost prevention. More particularly, the present invention relates to a system for frost prevention in an ultra low freezer environment.

BACKGROUND OF THE INVENTION

Many commercial enclosed spaces need to be equipped with pressure relief ports which are sometimes referred to as equalization or ventilator ports. This is particularly true where the sealed space is subjected to temperature related gas volume variations that must be relieved.

Many of these enclosed spaces require that a positive air pressure differential to ambient be maintained. However there are spaces where no differential is required or desired. Passive ports are suitable for these. However existing passive pressure relief ports, meaning those without fans or blowers, have often permitted humid air migration where there is no significant pressure differential. With freezers this causes undesirable condensation and frosting. Frosting is a substantial problem that occurs as ambient warm air drawn into a low temperature chamber releases significant amounts of moisture relative to the change in dew point of the air at high and low temperatures. Air is drawn through the port after each door opening cycle as the warm air that entered cools and contracts. If venting does not occur, a partial vacuum results which make it difficult to reopen the door. In extreme cases, the enclosures can even collapse.

A temperature rise in the enclosure between cooling cycles, and especially during a defrost cycle, creates a need to vent air to prevent pressure buildup. Again, failure to vent this pressure, with adequate relief capacity, can cause the chamber to rupture.

Passive pressure relief ports are in wide commercial use today. However, they have a number of limitations and disadvantages. Many have in line valves located within housing that extend through walls. Their space requirements dictate that they be larger than the wall thickness and thus protrude from one or both sides of the wall. Where they extend into a freezer, it is difficult to prevent ice from forming, even with internal heaters. Their values are often spring loaded and thus over time lose sensitivity. This results in leaky valves that permit air and moisture migration and seepage, which can cause frosting and icing.

Accordingly, it is seen that a need exists for a passive pressure relief port, i.e. one that is not electrically powered by fans and baffles, which can relive both positive and negative pressure differentials, yet which substantially prevents humid air migration under static differential conditions.

Freezers have a propensity to build up ice or frost on the interior surfaces of the cabinet due to the exchange of ambient, humid air into the cold compartment. The ambient air, even in air conditioned environments, has a typical relative humidity of 50% to 70%. This humidity, or water content of the ambient air is quickly frozen when it enters the freezer and manifests itself as the formation of frost, snow, or ice on the interior and the contents of the freezer. This frozen condensation obscures product labels, interferes with product removal, and necessitates periodic defrosting. Modern domestic freezers have defrost cycles the melt away this frozen condensation at periodic intervals. In laboratory application of ultra low temperature freezers, a defrost cycle cannot be tolerated due to the potentially detrimental effects the heat of defrosting would have on the samples stored inside the freezer cabinet. Therefore, minimization or elimination of the frost in the interiors by means other than conventional warm surface defrosting is value to the laboratory user of ultra low temperature refrigeration.

Accordingly, it is desirable to provide a method and apparatus that overcomes the above disadvantages and problems.

SUMMARY OF THE INVENTION

The foregoing needs are met, to a great extent, by the present invention, wherein in one aspect an apparatus is provided that in some embodiments minimizes or eliminates the production of condensation within the cabinet which later freezes or turns to frost by means other than conventional warm surface defrosting or heating.

In accordance with another aspect of the present invention, a dryer system for a refrigeration unit comprising an enclosure, a passive port mounted within said enclosure, and an air dryer apparatus wherein the air drying apparatus is coupled to the port for drying all incoming air. The port may be a pressure equalization port. The dryer apparatus further comprises a desiccant canister that is replaceable. The canister comprises one of a group consisting of silica-gel, activated carbon and other hygroscopic media.

In accordance with another aspect of the invention, the dryer apparatus comprises a porous polymer membrane for allowing gaseous air to pass through. This membrane is impermeable to water vapor in ambient air.

In accordance with yet another aspect of the invention, the dryer apparatus also comprises a plurality of dryers connected in parallel, a plurality of heaters in communication with the dryers, a humidity sensor and a controller in communication with the heaters and the sensor. The humidity sensor is disposed downstream of the dryers and upstream of the port and the heaters are wrapped around the dryers. Incoming air flows through one of a plurality of the dryers by way of a conduit connecting the dryers to the port. The conduit comprises a compressor valve in communication with an orifice which is in communication with at least one solenoid valve proximal the dryers. A controller is configured to alternatively switch or redirect the air flow path to the port via at least one solenoid valve in the conduit based on the sensed moisture content of each dryer. The humidity sensor determines the moisture content which activates the alternative switch or redirects air flow from one dryer to another. Upon this redirect, the controller activates the corresponding heater for regenerating the dryer from a moisture laden state to a dry state.

In accordance with still another aspect of the present invention, a method of drying incoming air to a refrigeration unit enclosure comprises the steps of providing a dryer apparatus in communication with a passive port mounted within the enclosure, preventing water vapor from entering the enclosure, and allowing gaseous air to pass through the dryer apparatus and to enter the enclosure.

In accordance with yet still another aspect of the present invention, a dryer system for a refrigeration unit, comprising a means for allowing gaseous air to pass through a dryer apparatus and to enter an enclosure and a means for preventing water vapor from entering the enclosure.

There has thus been outlined, rather broadly, certain embodiments of the invention in order that the detailed description thereof may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
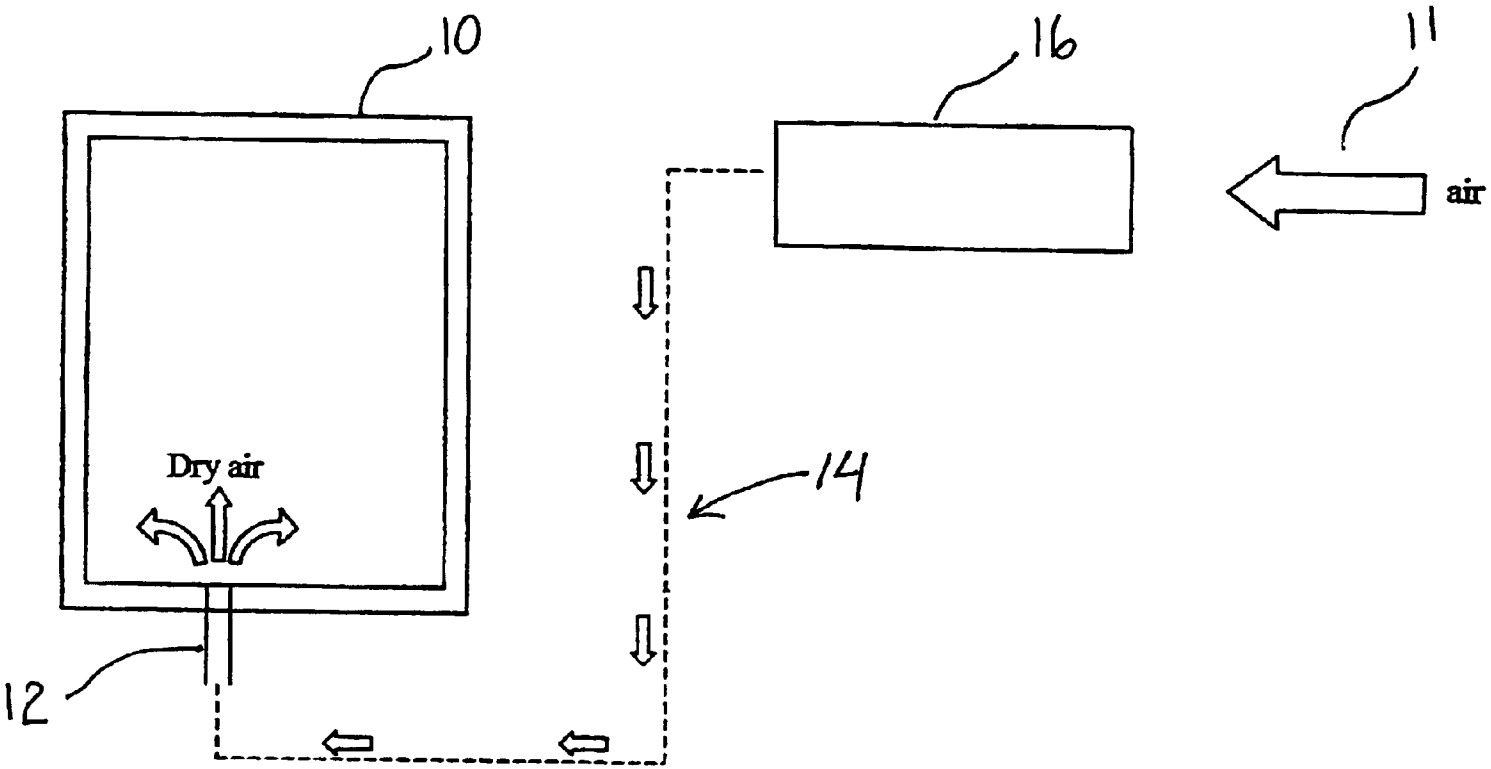
FIG. 1 is a schematic diagram illustrating a dryer system according to a preferred embodiment of the invention.

The invention will now be described with reference to the drawing figures, in which like reference numerals refer to like parts throughout. An embodiment in accordance with the present invention provides a method and apparatus which minimizes or eliminates the production of condensation within the cabinet of a freezer unit which may later freeze or turn to frost. The present invention provides a means other than a conventional warm surface defrosting or heating in order to overcome the condensation problem. The present invention also provides the benefits of minimizing or eliminating the need for performing a defrost cycle on the freezer unit which may result in damaging or destroying any materials stored within.

For instance, ambient air enters the cabinet 10 of an ultra low temperature freezer due to opening of the access door and due to variation in air density caused by the temperature fluctuations during the on-off cycling of the refrigeration system. During the cycling of the refrigeration system, ambient air 11 enters the cabinet through a passive port 12. This passive port 12 may be a pressure equalization port. Even if the access door (not shown) is never opened, the humid air that enters through the port 12 contains enough moisture to cause large amounts of frost buildup. The invention consists of coupling an air-drying system to a port 12 on the freezer cabinet 10. The dried air 14 will have little or no humidity and thus minimize or eliminate frozen condensation in the interior of the cabinet 10.

Referring to FIG. 1, one embodiment of the present invention is a disposable desiccant canister 16 that can hold a finite quantity of moisture before it must be replaced. This desiccant canister 16 is configured to be disposed in the port 12 as a barrier or transitional treatment of the incoming ambient air 11 as it enters port 12. The result will be a drier state of air entering the cabinet 10 as desired. The desiccant canister 16 may consist of silica-gel, activated carbon, or other hygroscopic media.

Figure 2:
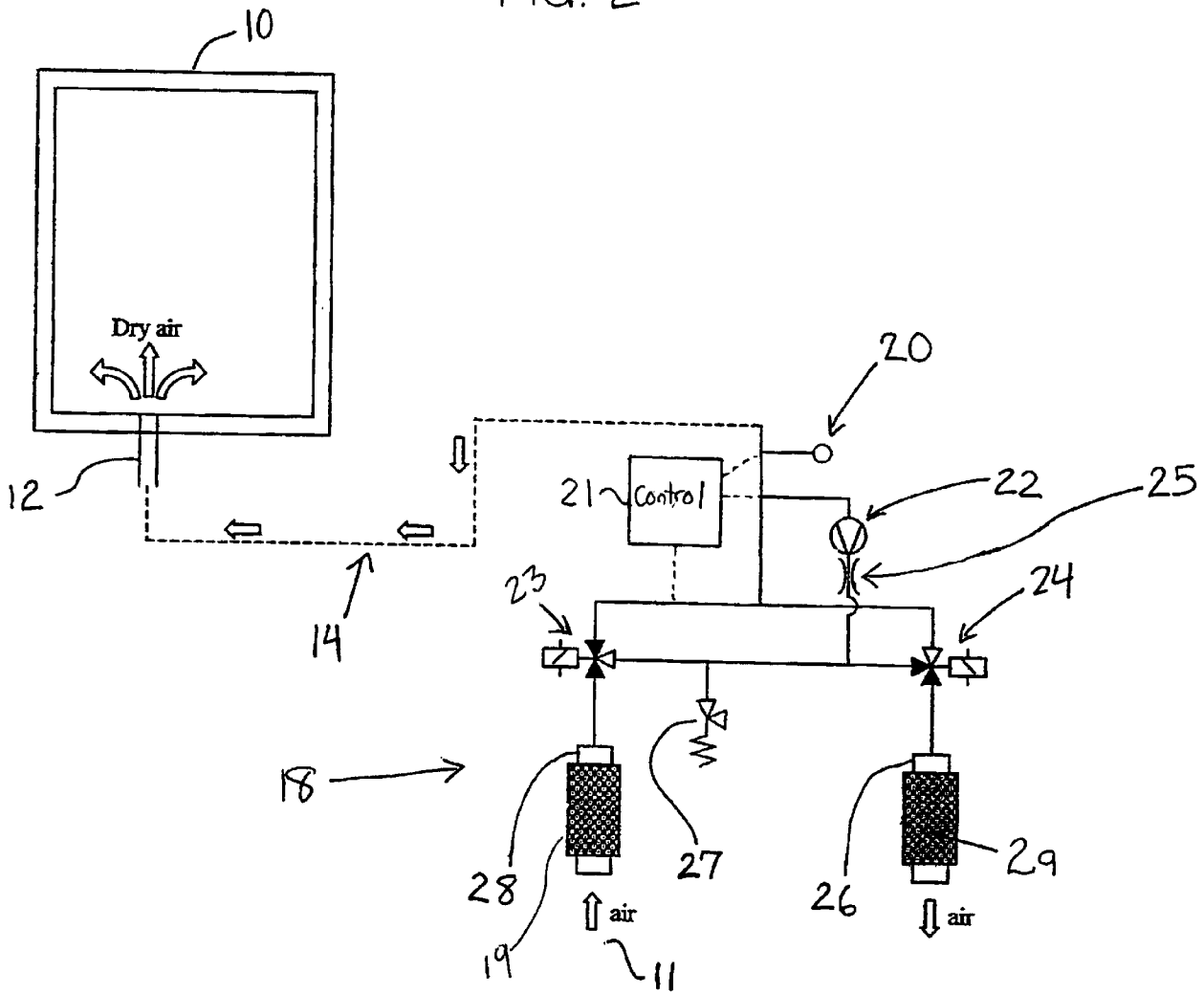
FIG. 2 is a schematic diagram illustrating a dryer system of a second embodiment of the invention.

Referring to FIG. 2, another embodiment of the present invention is a regenerating desiccant system 18 connected to port 12 and consisting of a plurality of dryers/absorbers 26, 28 wherein the air flow 11 can be diverted from one dryer/absorber 26 to another 28 so that the desiccant in the diverted dryer/absorber 26, 28 can be regenerated by means of heating 19, 29 the diverted dryer/absorber 26, 28. The system 18 may include a controller 21, a humidity sensor 20, a compressor 22, orifice 25, solenoid valves 23, 24, a pressure relief valve 27, heaters 19, 29 and dryer/absorbers 26, 28. The humidity sensor 20 will communicate to the controller 21 the moisture state of the processed air for status and tracking purposes and the like. Heaters 19, 29 may alternately regenerate absorbers/dryers 19, 29 once a finite quantity of moisture has accumulated within each absorber/dryer 19, 29. Solenoid valves are configured to also alternate the flow of incoming air 11 between the absorber/dryers 19, 29 as needed. The solenoid valve configuration includes a pressure relief valve 27 for proper flow purposes. Controller 21 dictates this alternating state by reading the humidity changes in the treated or dry air flow 14 and determining when to regenerate each absorber/dryer 19, 29 accordingly.

Figure 3:
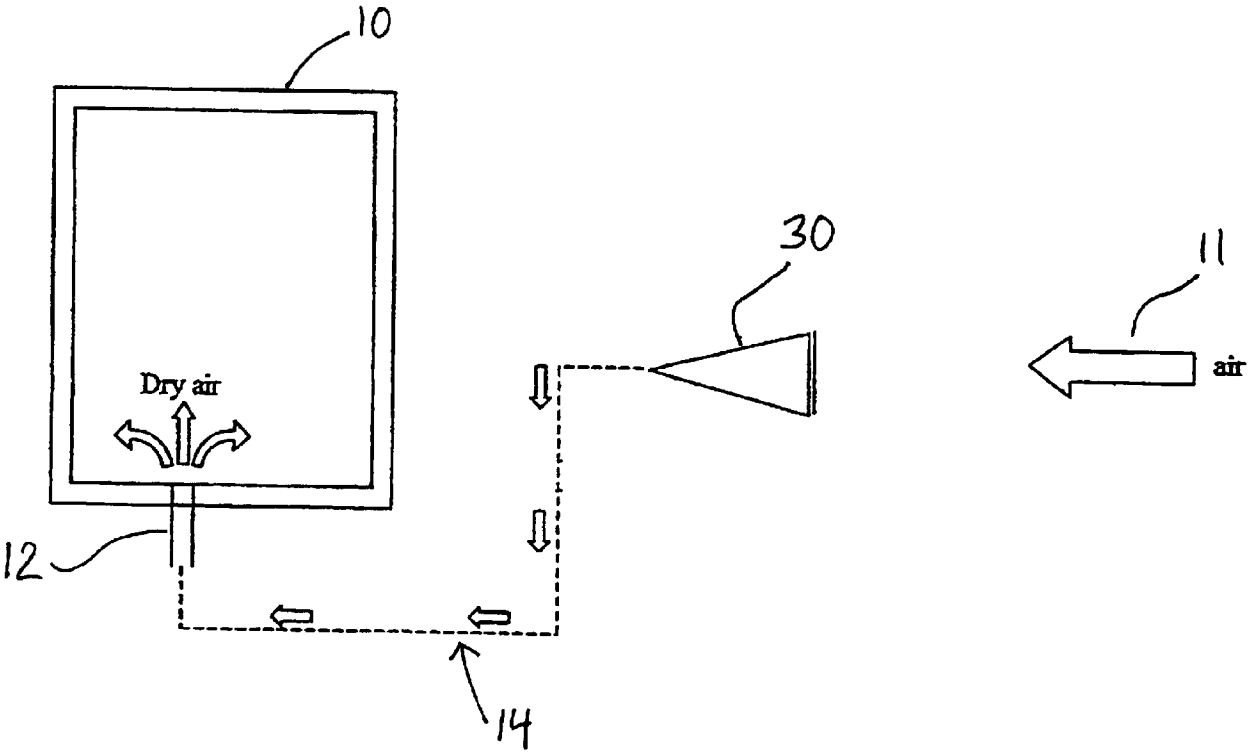
FIG. 3 is a schematic diagram illustrating a dryer system of a third embodiment of the invention.
Figure 1:
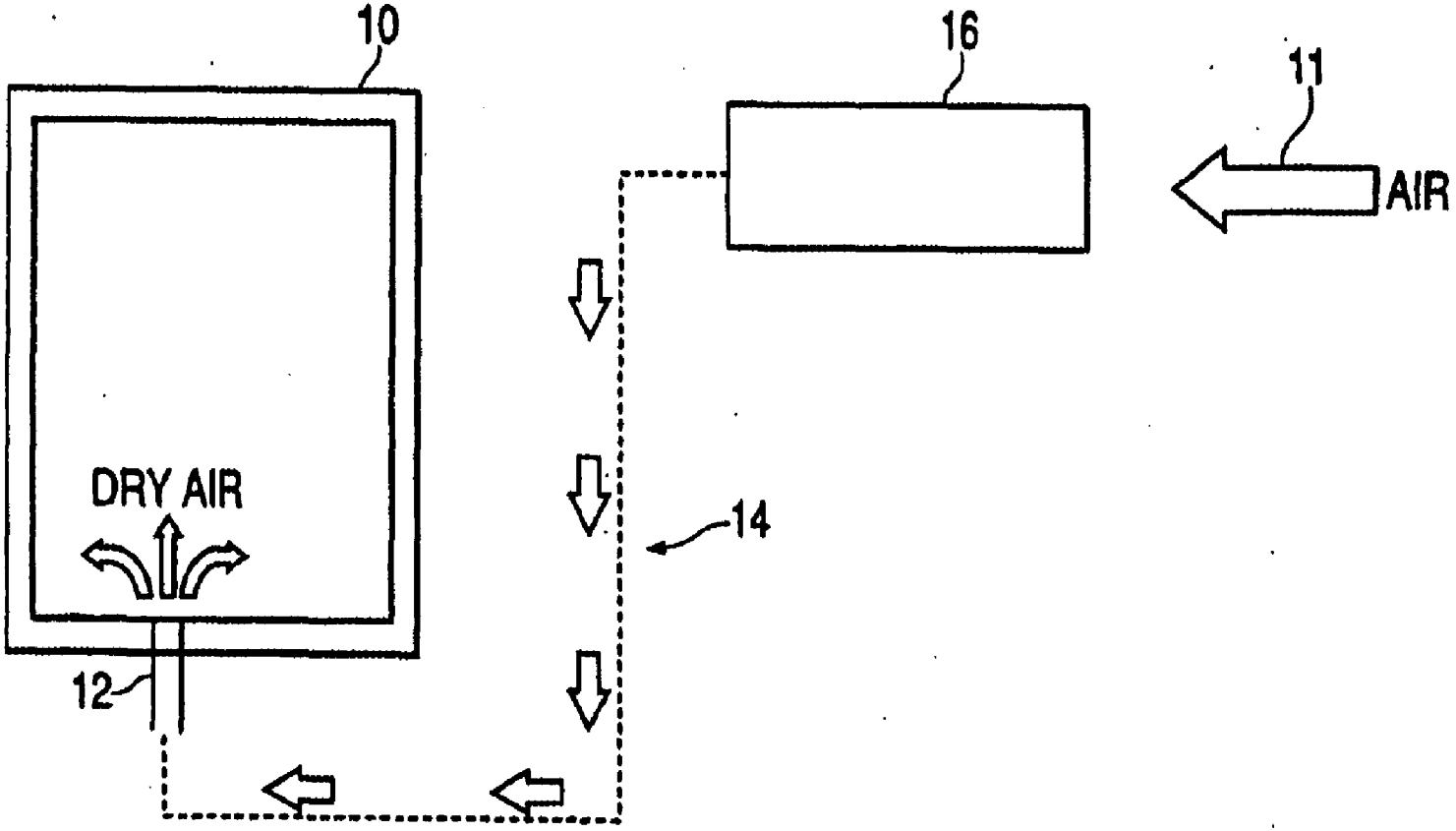
Figure 2:
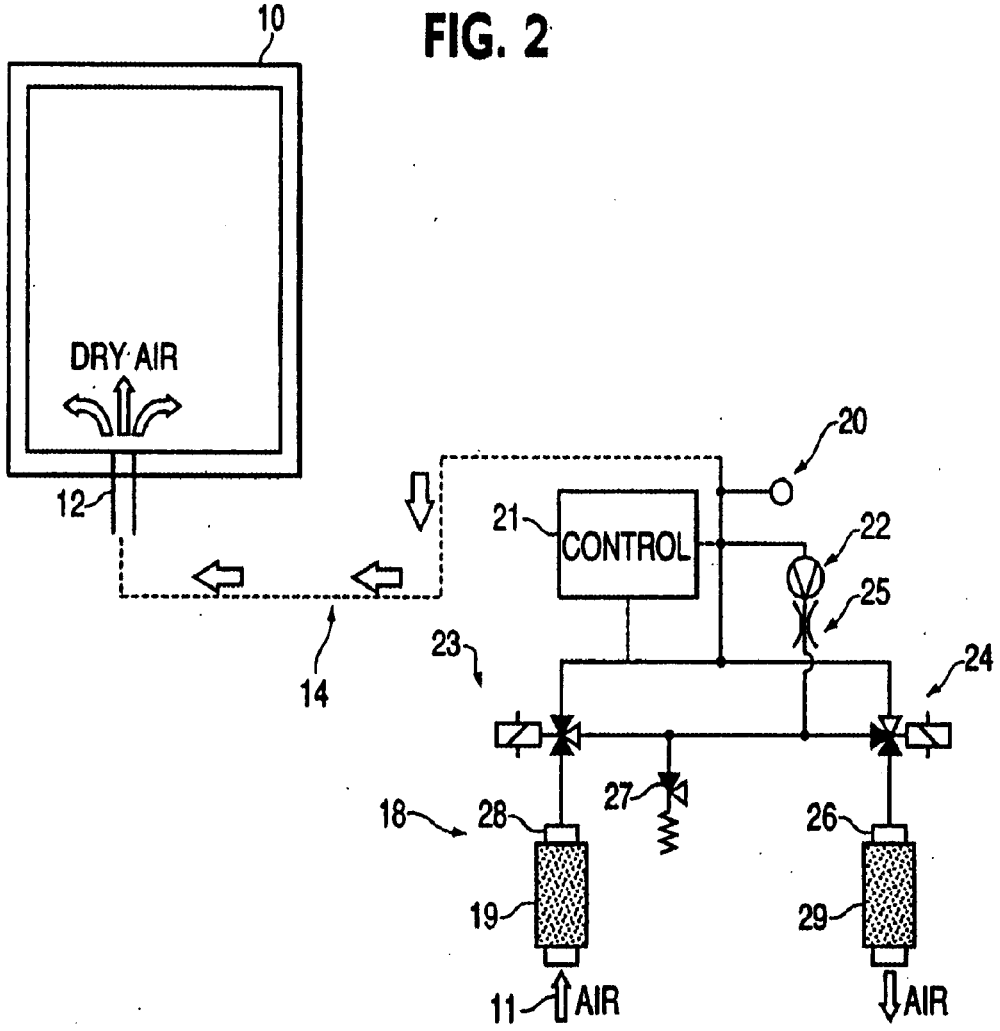
Figure 3:
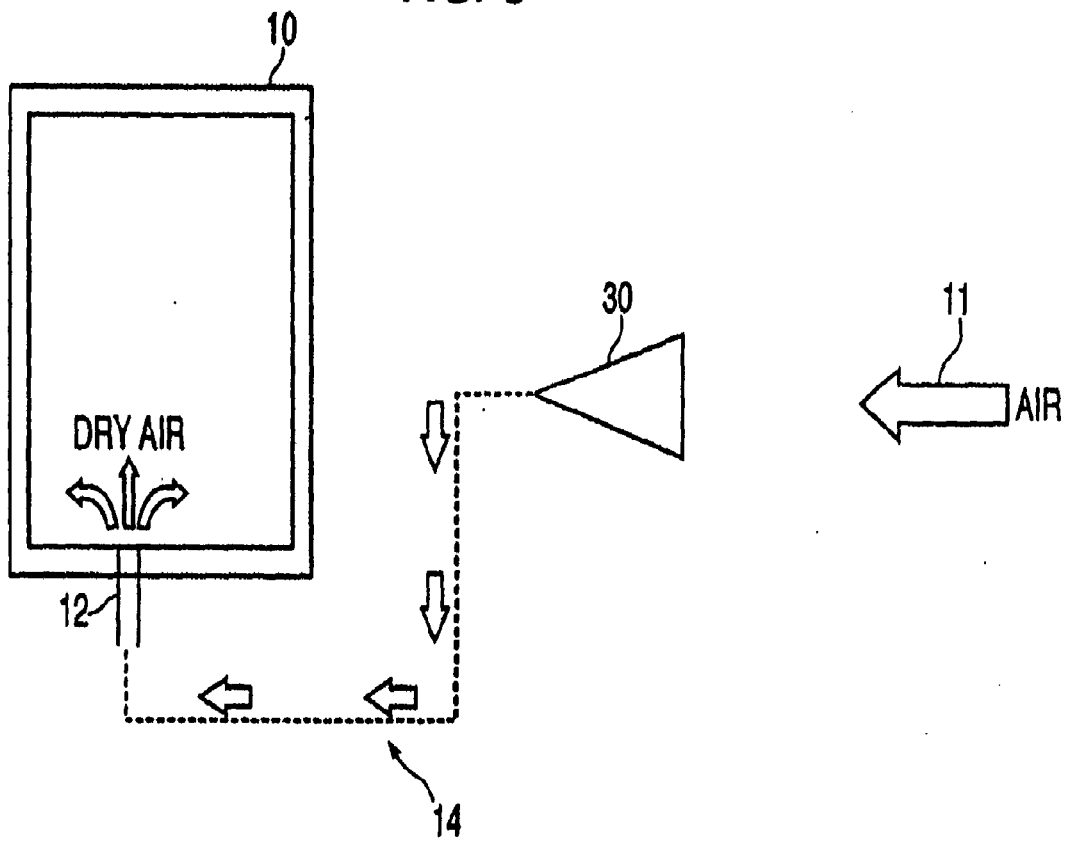

Referring to FIG. 3, still yet another embodiment of the present invention is a selectively porous polymer membrane 30 that allows gaseous air 14 to pass through but impermeable to water vapor in ambient air 11. This membrane 30 may be disposed within port 12 as a barrier or transitional zone for treating any incoming ambient air 11 as it enters port 12. Again, the result will be a drier state of air within the cabinet 10 thereby preventing or reducing any condensate from forming or later freezing.

For example in operation, the present invention may be coupled to a passive port 12 and the dryer apparatus may be configured to lie within or about the exterior portion of the port 12. The controller 21 may monitor humidity sensor 20 for any pre-determined levels of moisture content downstream of dryer/absorber 26, 28. Once a predetermined moisture level was indicated of detected, the controller 21 would activate the corresponding solenoid valves 23, 24 in order to redirect the incoming air flow 11 through another dryer/absorber 26, 28 accordingly. The controller then activates the corresponding heater 19, 29 wrapped about the now saturated dryer/absorber 26, 28 in order to regenerate that particular dryer/absorber 26, 28 for later use. If needed, the pressure relief valve 27 may also be activated during the redirect operation by controller 21. The redirected incoming air flow 11 now passes through the unsaturated dryer/absorber 26, 28 resulting in a dryer outgoing air flow 14 directed passed the humidity sensor 20 and into port 12.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A dryer system for a refrigeration unit, comprising:

an enclosure;

a passive port mounted within said enclosure; and an air dryer apparatus, wherein said air drying apparatus is coupled to said port for drying all incoming air, wherein said dryer apparatus comprises a desiccant canister and said canister is replaceable, wherein said canister comprises one of a group consisting of silica-gel, activated carbon and other hygroscopic media.

2. The system of claim 1, wherein said port is a pressure equalization port.

3. A dryer system for a refrigeration unit, comprising:

an enclosure;

a passive port mounted within said enclosure; and an air dryer apparatus, wherein said air drying apparatus is coupled to said port for drying all incoming air, wherein said dryer apparatus comprises a porous polymer membrane for allowing gaseous air to pass through.

4. The system of claim 3, wherein said membrane is impermeable to water vapor in ambient air.

5. A dryer system for a refrigeration unit, comprising:

an enclosure;

a passive port mounted within said enclosure; and an air dryer apparatus;

wherein said air drying apparatus is coupled to said port for drying all incoming air, wherein said dryer apparatus comprises:

a plurality of dryers connected in parallel;

a plurality of heaters in communication with said dryers;

a humidity sensor; and a controller in communication with said heaters and said sensor.

6. The system of claim 5, wherein said humidity sensor is disposed downstream of said dryers and upstream of said port.

7. The system of claim 6, wherein said heaters are wrapped around said dryers.

8. The system of claim 7, wherein incoming air flows through one of a plurality of said dryers by way of a conduit connecting said dryers to said port.

9. The system of claim 8, wherein said conduit comprises a compressor valve in communication with an orifice which is in communication with at least one solenoid valve proximal said dryers.

10. The system of claim 9, wherein said controller is configured to alternatively switch the air flow path to the port via the at least one solenoid valve in the conduit based on a moisture content of each dryer.

11. The system of claim 10, wherein said humidity sensor determines said moisture content which activates the alternative switch of air flow from one dryer to another.

12. The system of claim 11, wherein upon the alternative switch, the controller activates the corresponding heater for regenerating the dryer from a moisture laden state to a dry state.

13. A method of drying incoming air to a refrigeration unit enclosure, comprising the steps of:

providing a dryer apparatus in communication with a passive port mounted within the enclosure;

preventing water vapor from entering the enclosure; and allowing gaseous air to pass through said dryer apparatus and to enter the enclosure, wherein said dryer apparatus comprises a porous polymer membrane for allowing gaseous air to pass and is impermeable to water vapor in ambient air.

14. The method of claim 13, wherein said dryer apparatus comprises a desiccant canister.

15. The method of claim 13, wherein said dryer apparatus comprises:

a plurality of dryers connected in parallel;

a plurality of heaters in communication with said dryers;

a humidity sensor; and a controller in communication with said heaters and said sensor.

16. A dryer system for a refrigeration unit, comprising:

means for allowing gaseous air to pass through a dryer apparatus and to enter an enclosure; and means for preventing water vapor from entering the enclosure, wherein said dryer apparatus comprises a porous polymer membrane for allowing gaseous air to pass and is impermeable to water vapor in ambient air.

* * * * *

UNITED STATES PATENT AND TRADEMARK OFFICE

CERTIFICATE OF CORRECTION

PATENT NO. : 6,990,819 B2
APPLICATION NO. : 10/724624
DATED : January 31, 2006
INVENTOR(S) : William Brian Darling It is certified that error appears in the above-identified patent and that said Letters Patent is hereby corrected as shown below:

Drawings,
Replace the informal drawings with the attached three (3) sheets of formal drawings (FIGS. 1-3).

Signed and Sealed this

Fourth Day of July, 2006

JON W. DUDAS
*Director of the United States Patent and Trademark Office*

(12) United States Patent
Darling

(10) Patent No.: US 6,990,819 B2
(45) Date of Patent: Jan. 31, 2006

(54) DRYER SYSTEM FOR THE PREVENTION OF FROST IN AN ULTRA LOW TEMPERATURE FREEZER

(75) Inventor: William Brian Darling, Asheville, NC (US)

(73) Assignee: Kendro Laboratory Products, Newtown, CT (US)

( * ) Notice: Subject to any disclaimer, the term of this patent is extended or adjusted under 35 U.S.C. 154(b) by 190 days.

(21) Appl. No.: 10/724,624

(22) Filed: Dec. 2, 2003

(65) Prior Publication Data

US 2005/0028538 A1 Feb. 10, 2005

Related U.S. Application Data

(60) Provisional application No. 60/492,969, filed on Aug. 7, 2003.

(51) Int. Cl.
*F25D 17/06* (2006.01)

(52) U.S. Cl. ..... 62/94; 62/271

(58) Field of Classification Search ..... 62/92, 62/93, 271, 94; 96/7
See application file for complete search history.

(56) References Cited

U.S. PATENT DOCUMENTS

| | | | | | |
|---|---|---|---|---|---|
| 5,259,896 | A | * | 11/1993 | Park et al. | 156/78 |
| 5,768,897 | A | * | 6/1998 | Rainville et al. | 62/94 |
| 6,301,907 | B1 | * | 10/2001 | McCollin et al. | 62/93 |
| 6,397,620 | B1 | * | 6/2002 | Kelly et al. | 62/275 |
| 6,616,735 | B1 | * | 9/2003 | Burban et al. | 96/8 |
| 2003/0164091 | A1 | * | 9/2003 | Hill et al. | 95/90 |

* cited by examiner

*Primary Examiner*—Melvin Jones
(74) *Attorney, Agent, or Firm*—Baker & Hostetler LLP; Sean A. Pryor

(57) ABSTRACT

A dryer system for frost prevention in an ultra low temperature freezer includes a passive port coupled to an air dryer apparatus.

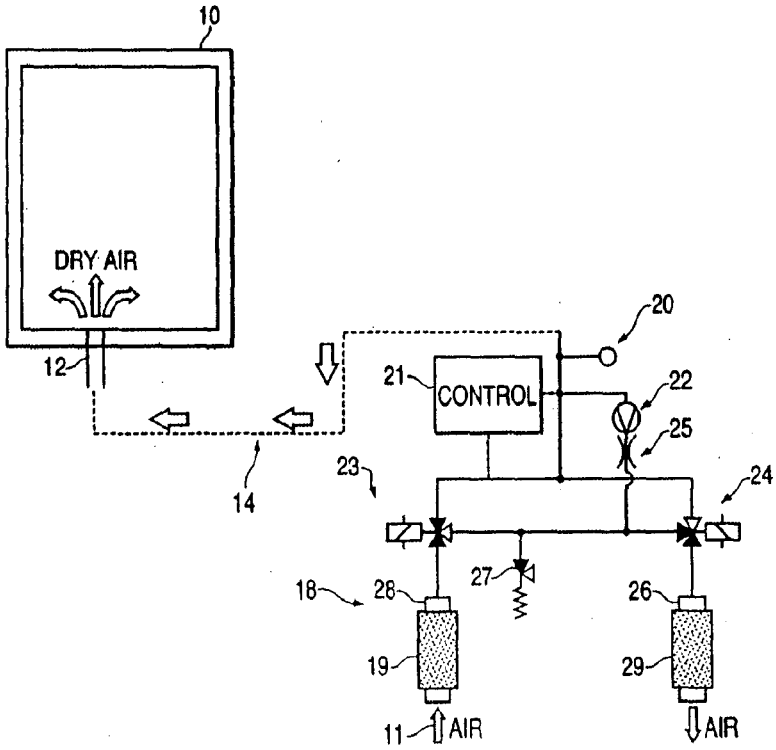

16 Claims, 3 Drawing Sheets